US006283633B1

(12) United States Patent
Gillespie et al.

(10) Patent No.: US 6,283,633 B1
(45) **Date of Patent: *Sep. 4, 2001**

(54) INTERCONNECTED PLASTIC BAGS CHARGING APPARATUS AND METHOD

(75) Inventors: Neill Peter Gillespie; Malcolm Alexander Crowe, both of Auckland (NZ)

(73) Assignee: Minigrip Flexible Packaging Limited, Auckland (NZ)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/404,137

(22) Filed: Sep. 27, 1999

Related U.S. Application Data

(62) Continuation of application No. 08/944,821, filed on Oct. 6, 1997, now abandoned, which is a continuation of application No. 08/507,371, filed as application No. PCT/NL94/00012 on Feb. 21, 1994, now abandoned.

(30) Foreign Application Priority Data

Feb. 23, 1993 (NZ) ..... 245979

(51) Int. Cl.[7] ..... B65D 30/00
(52) U.S. Cl. ..... 383/37; 383/61; 383/63
(58) Field of Search ..... 383/37, 61, 63, 383/67

(56) References Cited

U.S. PATENT DOCUMENTS

| | | | | |
|---|---|---|---|---|
| 4,260,116 | * | 4/1981 | Collin | 383/67 X |
| 4,630,311 | * | 12/1986 | Bentson | 383/63 X |
| 4,637,060 | * | 1/1987 | Ausnit | 383/63 X |
| 4,654,878 | * | 3/1987 | Lems | 383/37 |
| 4,665,552 | * | 5/1987 | Lems et al. | 383/63 X |

* cited by examiner

*Primary Examiner*—Jes F. Pascua
(74) *Attorney, Agent, or Firm*—Young & Thompson

(57) ABSTRACT

A series of interconnected bags (3) and a method and apparatus for the manufacturing and charging thereof. A series of bags (3) are blow formed from plastics film tube (5) which integrally incorporates the recloseable elements (6) adjacent what will become a top (8) of each bag (3). The plastic film tube (5) is longitudinally slit opposite the recloseable elements (6) to provide connecting strips (12) extending along each side of what also becomes open bottoms (10) of the bags (3). Support rails (7) are provided, preferably integrally, on each strip (12). The recloseable elements (6) are engaged with one another prior to transverse seals (13) and severing cuts (14) being formed at bag forming intervals along the film material (5). The seals (13) and cuts (14) extend from the tops (8) of the bags (3) to the strips (12). The engaged recloseable elements (6) are thus enclosed and cutting the top (8) of a bag (3) is necessary to access the recloseable elements (6). The support rails (7) enable the bags (3) to be suspended bottom (10) uppermost and conveyed through a charging and sealing apparatus. Following charging the strips (12) are removed to separate the bags (3) therefrom and from one another.

2 Claims, 3 Drawing Sheets

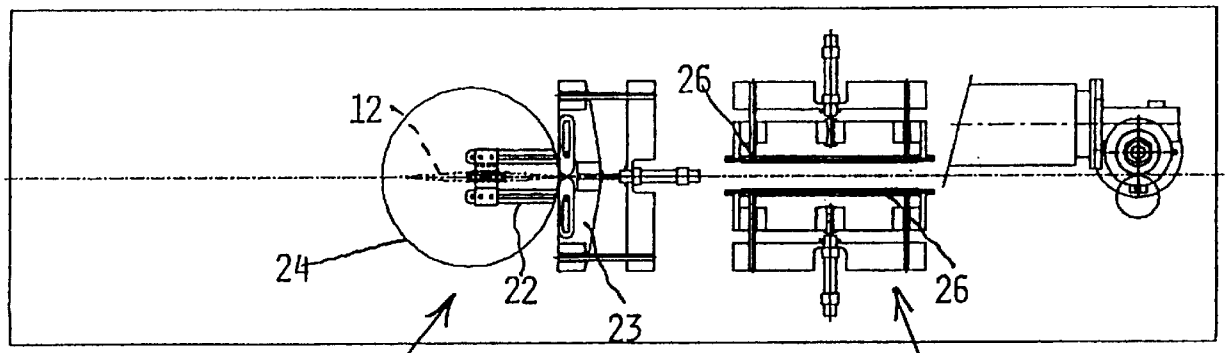
FIG 5
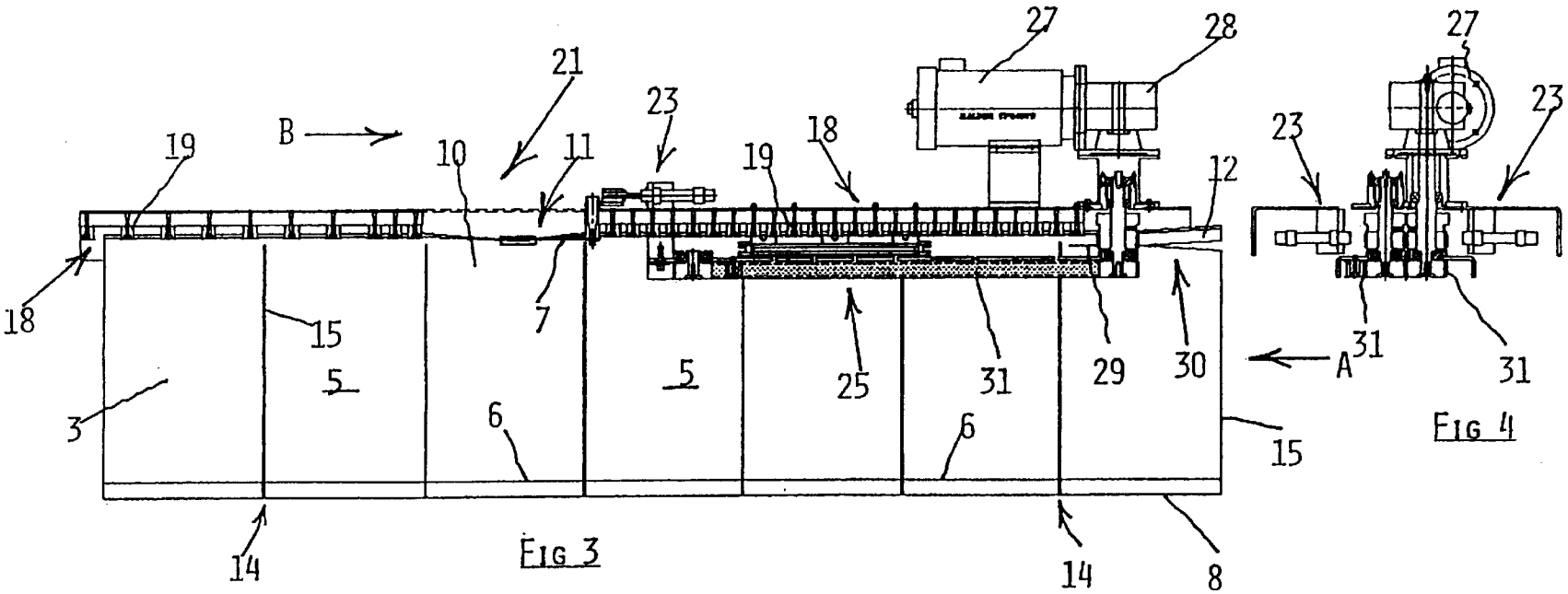
FIG 4
FIG 3

INTERCONNECTED PLASTIC BAGS CHARGING APPARATUS AND METHOD

CROSS-REFERENCE TO RELATED APPLICATIONS

This application is a continuation of application Ser. No. 08/944,821, filed Oct. 6, 1997, now abandoned, which is a file wrapper continuation of Ser. No. 08/507,371, filed Oct. 5, 1995, now abandoned, which was the 35 U.S.C. 371 national phase of International application PCT/NZ94/00012, filed Feb. 21, 1994, which designated the United States.

TECHNICAL FIELD

This invention relates to a series of interconnected plastics bags incorporating recloseable elements and an apparatus and method for the automatic charging and sealing thereof. In particular the invention relates to such a series of bags adapted for bottom filling and which are linked by a continuous strip adapted to support the bags during a charging process and provide automatic separation following the charging and sealing thereof.

BACKGROUND ART

Plastic bags incorporating recloseable elements including bags interconnected in a series to assist automatic charging are well known. Also various apparatus is available and known for the automatic charging of such interconnected bags. U.S. Pat. Nos. 4,665,552, 4,630,311, 4,514,962 relate to such interconnected bags and charging apparatus. A problem can arise in charging such bags with, in particular, detritus or similar fine ground matter from the top as some of the charge may lodge in or on the recloseable elements hindering their operation. A further problem can be that with such a recloseable bag evidence of tampering, such as unauthorised access via the recloseable elements, is not provided for. An object of this invention is to provide a series of interconnected bags which it is envisaged will overcome or at least alleviate the aforesaid problems. Further, it is envisaged that the associated charging apparatus and method will provide a particularly effective way of achieving these desired objects.

DISCLOSURE OF INVENTION

According to a first aspect of this invention there is provided a series of bags each having engaged recloseable elements disposed adjacent what will become tops of the bags, side edges of the bags being formed by heat seals and associated severing which separate the bags from one another except for a continuous strip including a support rail extending along what will become bottom extremities of the bags, the edge forming seals also sealing the edges of a fold of the bag forming material which extends between the engaged recloseable elements to form the tops of the bags.

According to a second aspect of this invention there is provided a series of bottom opened interconnected bags having engaged recloseable elements adjacent what, following charging through and sealing of a bag bottom, will become a top of the bag comprising a continuous strip interconnecting the bags along bottom opening defining extremities of opposing sides of the bags, each strip including a support rail by which the bags in a bottom uppermost and open mode can be supported during charging, the support rails being appropriately spaced from the conjunctions of the strips with the bottom opening defining extremities of the bags to provide a bag of a required volume following charging and then sealing the bottom openings of the bags while they remain supported on the support rails prior to severing of the bags from the strips.

According to a third aspect of this invention there is provided a method of manufacturing a series of bottom opened interconnected bags having engageable recloseable elements comprising the steps of blow forming a tube of parent bag forming material incorporating recloseable elements adjacent what will become a top of the bags and, substantially opposite the recloseable elements and bordering what will become the bottom of the bags, a section which will form strips connecting the bags, engaging the recloseable elements together either before or after slitting the tube longitudinally along the connecting strip forming section to form a connecting strip to each side thereof and applying at bag forming intervals transversely disposed heat seals and associated severing extending across the parent material except for the connecting strips.

According to a fourth aspect of this invention there is provided a method of charging a series of interconnected bags as claimed herein comprising the steps of providing, if not already provided, a support rail for each of the strips from which the series of bags can be suspended bottom uppermost, advancing the series of bags through a charging station, at which the bottom of each bag is opened and a charge inserted, to a sealing station at which the bottoms of the bags are sealed and then transporting the bags to severing means and severing the bags from the interconnecting strips.

According to a fifth aspect of this invention there is provided an apparatus for charging a series of bottom opened interconnected bags provided with support rails as claimed herein comprising a support track for each of the strips and along which a series of bags can be advanced through a charging station to a sealing station comprising pinch operative sealing elements, at the charging station a pair of arms being mounted to be engageable one with each of the opening defining sides of the bags to space them apart to individually open each bag and support same during charging thereof, the apparatus then transporting the bags to severing means downstream of the sealing station and which severs the bags from the interconnecting strips.

BRIEF DESCRIPTION OF THE DRAWINGS

FIG. 3 is a side view of a series of bags being conveyed through a charging apparatus which includes a charging station, sealing means and severing means, and FIGS. 4 and 5 are an end view, in the direction of arrow A on FIG. 3, and a plan view respectively of the apparatus of FIG. 3.

BEST MODE FOR CARRYING OUT THE INVENTION

A series of interconnected bags 3 are preferably fabricated from a parent film tube 5 of blown plastics film materials.

Figure 2:
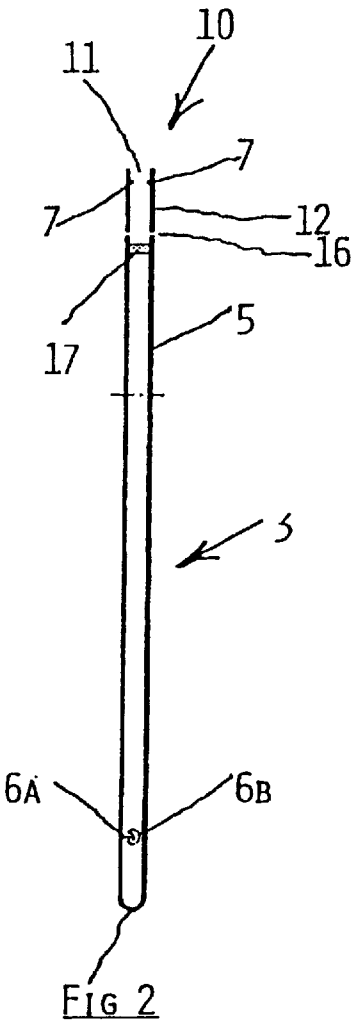
FIG. 2 is a cross-sectional view of a bag depicted in FIG. 1.
Figure 1:
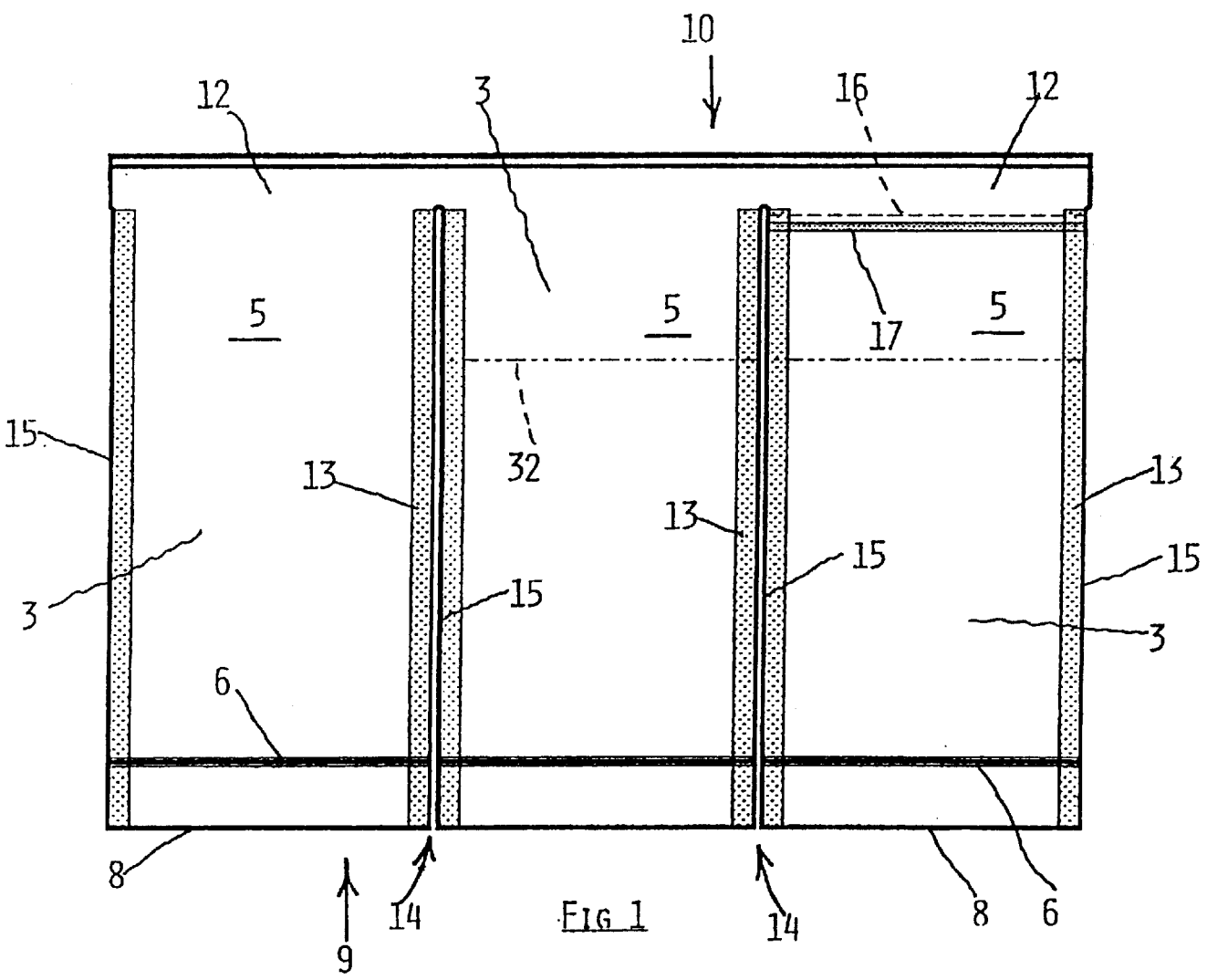
FIG. 1 is a side view, partly schematic, of three interconnected bags (representing a continuous series of such bags) formed from a parent tube of plastics film material.

Preferably the tube film material 5 integrally incorporates recloseable profiles 6*a* and 6*b* and and integral support rails 7 although it is envisaged the support rails 7 may be added later. With folding or collapsing of the tube material 5 into a substantially two layered band, as depicted in FIGS. 1 and 2, the recloseable profile 6*a* and 6*b* are engaged with one another. The profiles 6*a* and 6*b* may be of any required known form comprising basically. a male element 6*a* re-engageable within a female element 6*b*. The folding of the tube film material 5 provides that the recloseable profile 6*a* and 6*b* are adjacently set in from one fold 8. As will be apparent from the following description eventually the recloseable profiles 6*a* and 6*b* and the associated section of the film material 5 forming fold 8 will become the tops 9 of bags 3.

The support rails 7 are disposed adjacent the opposing "fold" 10 of the tube material 5. More particularly, following blow forming and as depicted the tube film 5 is longitudinally slit on "fold" line 10 between the support rails 7. This provides open bottoms 11 enabling access to the individual bags 3. The slitting of fold 10 also forms interconnecting strips 12, one associated with each rail 7, and which following formation of the individual bags 3 as hereinafter described connect the bags 3 in a series as depicted.

At required bag 3 forming spacings transversely disposed heat seals 13 and associated severing cuts 14 are applied to the parent film 5 to form the side edges 15 of the bags 3 and separate, save for the connecting strips 12, the bags 3 from one another. The seals 13 and cuts 14 extend transversely in from the top 9 forming fold 8 of the film material 5 and terminate at the strips 12. More particularly, the seals 13 and cuts 14 terminate marginally beyond an intended bottom, represented by line 16 on FIG. 1, of the bags 3. As described hereinafter following charging of the bags a bottom closing seal 17 is formed adjacent the bottom line 16 and the bags 3 severed from the strips 12. The severing is along line 16 as to intersect with cuts 14 thereby providing for the separation of the bags 3 from one another and the strips 12.

The side edge seals 13 extend transversely across the recloseable profiles 6*a* and 6*b* and the associated folded section of the film material 5 forming the tops 8. Thus the recloseable profiles 6*a* and 6*b* are sealed-off by the folded top 8 and the seals 13. This provides that in a completed bag 3 the folded top 8 must be cut to access the recloseable profiles 6*a* and 6*b* thereby providing security against tampering.

Figure 8:
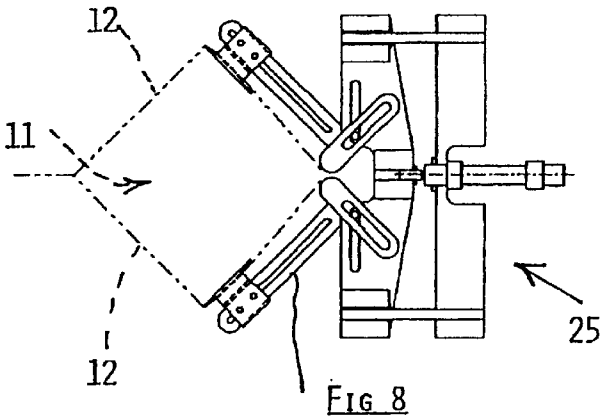
FIG. 8 is a similar view to FIG. 7 showing the opening arms open.
Figure 10:
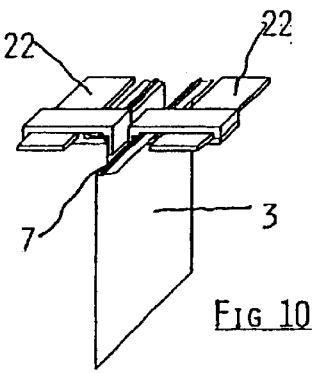
FIGS. 9 and 10 are an end view and a perspective view of the opening arms and their means of engaging and supporting bags.
Figure 9:
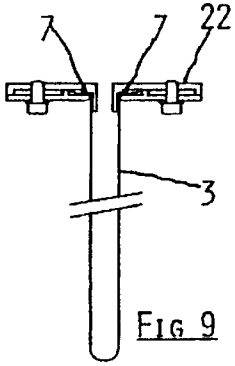
Figure 7:
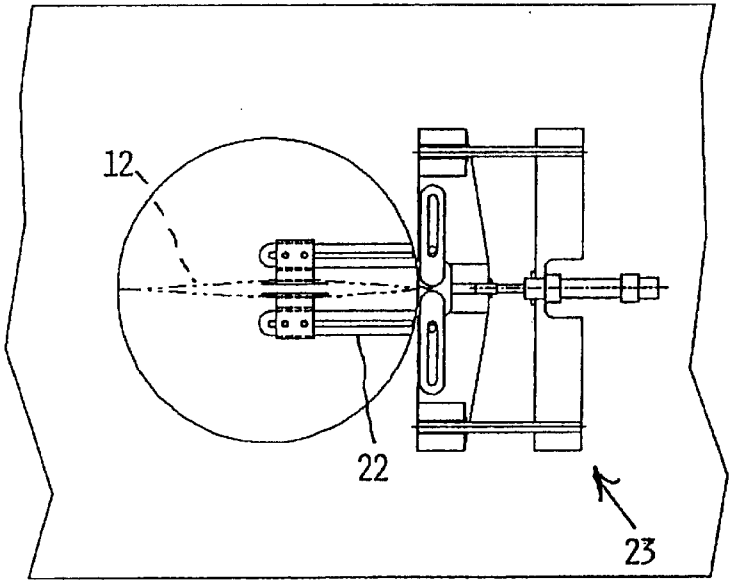
FIG. 7 is a plan view of the charging station with opening arms thereof near closed.
Figure 6:
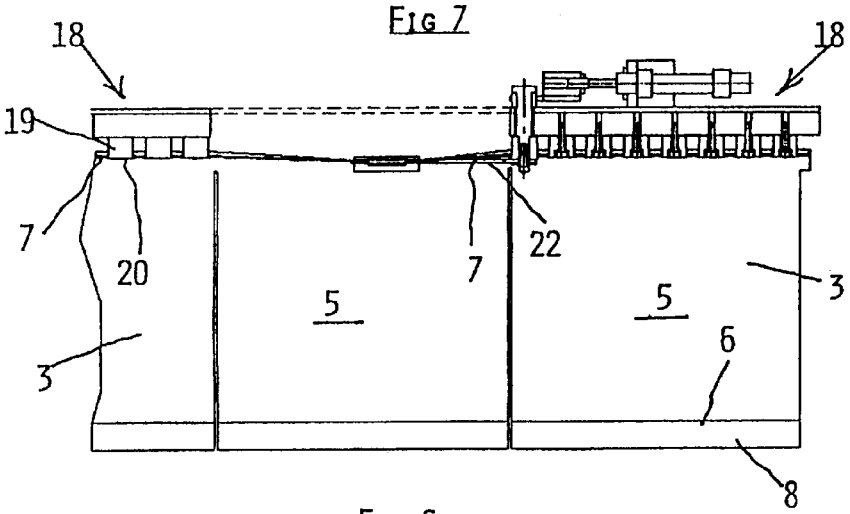
FIG. 6 is a side view of the charging station.

Thus a series of bags 3 are provided interconnected by strips 12 extending along what will become the bottom of the bags 3. Each strip 12 carries a support rail 7 the purpose of which is to support the series of bags 3 on tracking means 18 extending through a charging and sealing apparatus as depicted in FIGS. 3–5 inclusively and now more particularly described. The series of bags 3 are conveyed through the charging and sealing apparatus in the direction of arrow B on FIG. 3. The bags 3 are supported bottom uppermost by rails 7 seating over tracking means 18. Preferably tracking means 18 is formed by a pair of parallel series of adjacently spaced apart rollers 19 mounted on vertically disposed axis, each roller 19 incorporating at a lower end thereof an annular rib 20 on which the rails 7. rest. The bags 3 are conveyed to a charging station 21 at which the rails 7 slide into and are gripped by opening arms 22. As depicted in FIG. 8, arms 22 are operable by a suitable mechanism 23 to extend laterally to bottom open individual bags 3 in readiness for charging in known manner, for example, from a chute (depicted schematically by ring 24 on FIG. 5) disposed above charging station 21. A maximum charge volume is represented by line 32 on FIG. 1. Following charging bags 3 are conveyed along tracking means 18 to a sealing apparatus 25. Sealing apparatus 25 preferably comprises a pair of laterally positioned and operative heated bars 26 which can be impinged inwardly onto the bags 3 to form the bottom seal 17 as described above. Thereafter the bags 3 are conveyed to a severing apparatus comprising a horizontally extending blade 29 disposed to intersect the bags on line 16 to sever the strips 12 from the bags 3 as depicted at arrow 30. Preferably the bags 3 are driven along the tracking means 18 by a pair of continuous belts 31 disposed to either side of the bags 3 to impinge the bags therebetween and preferably extending from the sealing means 25 through to the severing blade 29. An electric motor 27 and associated drive train 28 are provided to rotate the belts 31 to draw the bags 3 through the apparatus.

What is claimed is:

1. A series of bags, comprising:

plural side-by-side plastic bags that each have a first end portion with an edge closed with folded plastic, an opposing second end portion where the plural bags are attached to each other, and opposing sides;

the first end portion of each of the plural bags being further closed with a selectively recloseable element that is adjacent to, yet spaced from, the edge of the first end portion;

the opposing sides of each of the plural bags being separated from the sides of adjacent ones of the plural bags by severing cuts that extend from the edges of the first end portions to the second end portions of the plural bags;

the second end portions of the plural bags comprising a continuous strip of plastic that extends the length of the series of bags;

the sides being continuously sealed closed along the severing cuts from the edges of the first end portions to the continuous strip;

a support rail extending the length of the series of bags and being located between an edge of the continuous strip and ends of the severing cuts; and the second end portion of each of the plural bags being sealed closed with a seal that terminates adjacent to corresponding ones of the severing cuts, thereby enabling complete separation of the plural bags from each other upon severing the continuous strip between the seal and the ends of the severing cuts.

2. The series of bags of claim 1, wherein the support rail is integrally molded with the continuous strip.

* * * * *